United States Patent [19]

Thaxton

[11] Patent Number: 4,861,027

[45] Date of Patent: Aug. 29, 1989

[54] TENNIS PRACTICE AND GAME APPARATUS

[76] Inventor: George K. Thaxton, 758 S. County Rd., Palm Beach, Fla. 33480

[21] Appl. No.: 128,711

[22] Filed: Dec. 4, 1987

[51] Int. Cl.[4] ..... A63B 61/00

[52] U.S. Cl. ..... 273/29 A; 273/26 A; 273/402

[58] Field of Search ..... 273/29 R, 29 A, 26 R, 273/30, 26 A, 410, 394, 402, 26, 29 AR; 124/36, 16

[56] References Cited

U.S. PATENT DOCUMENTS

| | | | |
|---|---|---|---|
| 1,923,297 | 8/1933 | Cooper | 273/26 A |
| 2,040,228 | 5/1936 | Whiteley | 273/26 A |
| 2,059,365 | 11/1936 | King | 273/26 A |
| 3,410,556 | 11/1968 | Kaiser et al. | 273/30 |
| 3,810,616 | 5/1984 | Murphy | 273/26 A |
| 3,989,246 | 11/1976 | Brown et al. | 273/29 A |
| 4,083,559 | 4/1978 | Owen, Jr. | 273/26 A |
| 4,368,885 | 1/1983 | Katada et al. | 124/16 |
| 4,390,181 | 6/1983 | Parish | 273/26 A |
| 4,415,154 | 11/1983 | Englehardt | 273/26 A |

FOREIGN PATENT DOCUMENTS

| | | | |
|---|---|---|---|
| 2526667 | 11/1983 | France | 273/29 R |
| 1592757 | 7/1981 | United Kingdom | 273/29 R |
| 2575076 | 6/1986 | United Kingdom | 273/29 A |
| 86/105701 | 10/1986 | World Int. Prop. O. | 273/30 |

*Primary Examiner*—T. Brown

*Attorney, Agent, or Firm*—Victor F. Volk

[57] ABSTRACT

A tennis playing game apparatus of the type with a simulated net has a narrow hole cut through the net and a ball-throwing machine to throw balls through the hole. A thick layer of foam polymer and a layer of sheeting are provided to damp the rebound of tennis balls.

2 Claims, 1 Drawing Sheet

TENNIS PRACTICE AND GAME APPARATUS

BACKGROUND OF THE INVENTION

The present invention includes improvements in the apparatus described in my patent No. 4592547, disclosures of which are incorporated herein by reference. The patent describes a tennis-ball catching, sheeted structure wherein a background sheet defines an opening that serves as a target. Balls that enter the opening are returned through a chute into a bin whose front wall simulates a tennis net, being of the same height.

It was considered desirable to adapt the patented apparatus to return balls to a player without losing the net simulating effect of the front wall of the bin and to render the apparatus operable indoors within very limited playing areas. Within the confined space it was also desired to provide a return ball option whereby players could strike back their own struck balls.

SUMMARY OF THE INVENTION

In an apparatus for practicing tennis of the type where balls are are hit over a simulated net into a flexible sheet that deflects them into a collecting bin, I have invented the improvement of cutting a narrow opening through the simulated net and providing a ball-throwing machine to throw balls through this opening. I have also provided a funnel to feed spent balls into the machine. By these means a player is not distracted by the machine from the aspect of hitting over a net as in a real game of tennis.

I have also invented rebound damping means that permit a person to play with standard tennis balls and racket, practicing the strokes usually used in tennis but within a very confined area. This rebound damping means comprises a rigid surface, a thick layer of synthetic polymeric foam material, such, for example, as a 1 ½ inch layer of foam polyurethane with a compression number of about 3560, bonded to the rigid surface, and a layer of flexible sheeting, such as a polyurethane film reinforced with woven polyester fiber, covering the foam. The rigid surface may advantageously be that of a portable plywood board so that the rebound damping unit can be hung onto the frame supporting the sheet of the practicing apparatus. Where this sheet has an opening serving as a target my damping unit may advantageously have a target painted upon it to appear to the player in the same place as the opening.

DETAILED DESCRIPTION OF PREFERRED EMBODIMENTS

Figure 1:
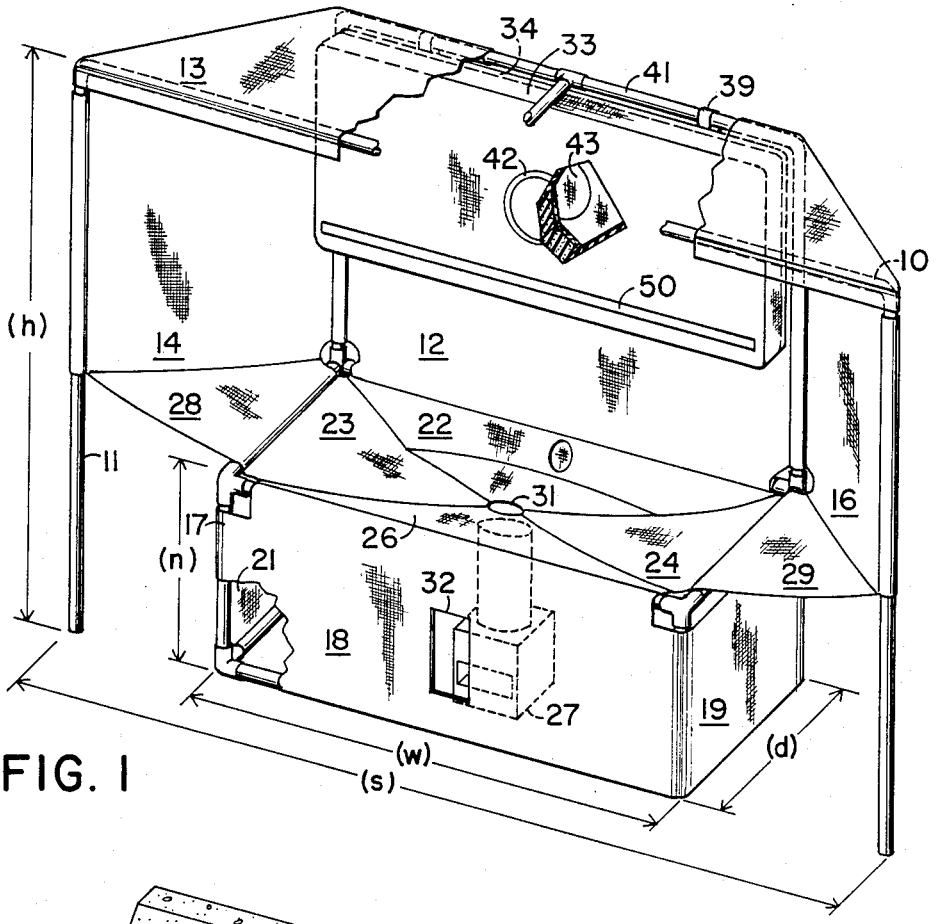
FIG. 1 is a perspective, partially cut away, of my apparatus with a rebound damping board installed.

Referring first to FIG. 1 my apparatus 10 for practicing tennis comprises a frame 11 of polyvinyl pipe supporting a back sheet 12, overhead sheet 13 left wing sheet 14, and right wing sheet 16. The frame 11 also forms a bin 17 that comprises a front, net simulating, wall 18, and optional side walls 19 and 21. Four curved sheet members 22, 23, 24, 26 form a funnel means across the top of the bin to direct all balls therein into a ball throwing machine 27. To assure that balls striking the sheets 14 and 16 will enter the bin I have provided triangular sheet members 28 and 29 connecting the bin 17 to the wings 14 and 16. An opening 31 for entrance of balls into the ball throwing machine 27 is provided at the confluence of the sheets 22, 23, 24, 26. I have discovered that I can maintain the desirable effect of the simulated net on a player who is trying to perfect his skills at competitive tennis by retaining the sheet 18 but cutting a narrow opening 32 in it through which balls can be launched by the ball throwing machine 27 without distracting the player's concentration.

The embodiment of my apparatus described herein is intended for indoors or in limited areas, such as back yards or front lawns, which gives it much greater utility. For this reason the dimensions are smaller than those described in my patent No. 4592547. For example, the present width "w" is about 50 inches (1.3 m), the overall spread "s" is about 8 ft. (2.5 m), the depth "d" is about 33 inches (0.8 m) and the height "h" is about 7 ½ feet (2.3 m). The height "n", however remains 3 feet (0.91 m), since it must develop the instinctive feel for standard tennis play. The opening 32 is about 8 inches (20 cm) wide and 18 inches (46 cm) high.

Figure 2:
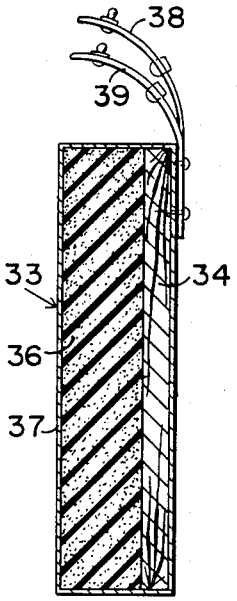
FIG. 2 is a section of my rebound damping board.

The ball-throwing machine 27 is one of a number of commercially available machines of this type that was chosen because it could be adjusted to throw a slow ball. I have found that a setting that will throw out a ball to bounce about 5 feet forward every three seconds will provide good practice to an experienced player who can use different stroking to try to return the balls through the target opening 43 in the sheet 11. In FIG. 1 this opening is mostly obscured by a rebound board 33 (see also FIG. 2) which can be used when the ball throwing machine is not employed.

In the use of a rebound board I have found a means of repeatedly bouncing a tennis ball within a small area. This has been accomplished by using a plywood, or other light, rigid board 34 and bonding to it a thick layer 36 of foam material. I have found that a polyurethane foam with an industry recognized compression number of 3560 and a thickness of 1 ½ inches (38 mm) damps the rebound just enough to make the game playable with standard tennis balls and rackets.

The facing surface of the foam layer 36 is covered with a layer 37 of sheet material which protects the foam from abrasion and combines with it to provide the proper rebound. The sheet material I prefer is a polyurethane film reinforced with openly woven (about 13 picks per inch) polyester fabric. This has the required toughness, weather resistance, and flexibility but I do not wish my invention to be limited to this sheeting or to the described foam if others are found that will serve this purpose. The layer of reinforced film 37 is wrapped completely over the board 33, protecting the edges and back of the plywood 34 as well as the edges of the foam from moisture and dirt. Straps 38, 39 serve to hang the board 33 on a horizontal member 41 of the frame 11. The sheet surface of the rebound board 33 has a painted target 42 so placed as to simulate the hole 43 (shown in FIG. 1 where the rebound board is cut away) in the back sheet 16 through which balls are hit when the throwing machine 27 is being used. The rebound board 33 is also marked with a strip 50 matching a similar strip (not shown) on the back sheet 12.

By using the rebound board a player can vary the shots without changing the setting of the machine, but more skill is required to continue play for long times.

Without the foam on the rebound board, of course, the rebounds would be too strong to play in a confined area, and the balls would bounce too far away for a player consistently to strike the board, which is only about 2×4 feet (0.6×1.2 m) in area.

Figure 3:
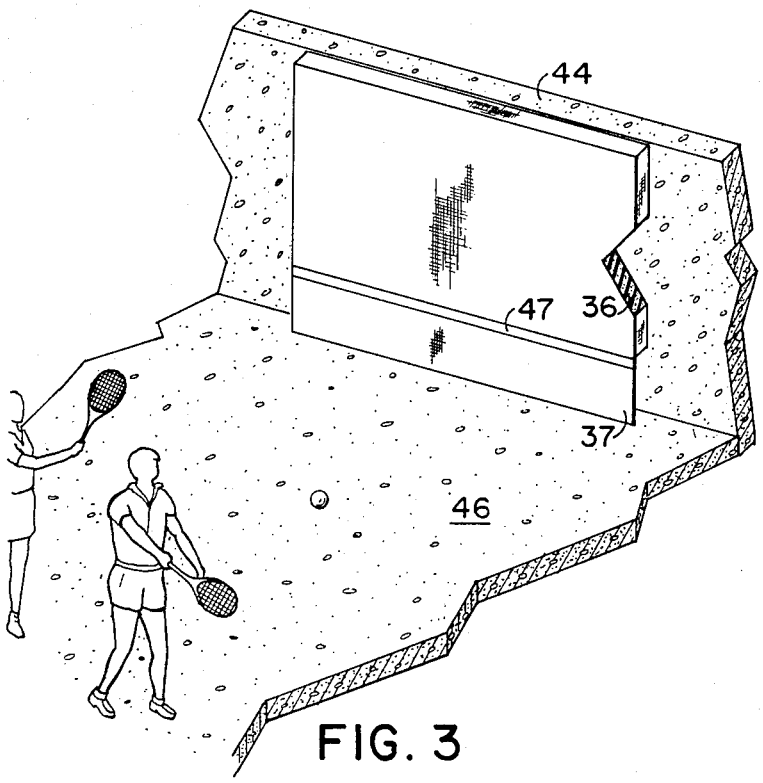
FIG. 3 is a partially sectionalized perspective view of a handball court adapted to tennis by my rebound damping means.

In FIG. 3 I have shown a masonry wall customarily used for handball or the like having an area adapted to practice tennis by the use of my rebound damping invention. Here my foam damper 36 (much exaggerated in depth in the drawing) is bonded directly to the surface of the wall 44 and the fabric-reinforced film 37 is adhered to the front surface of the foam. The foam may extend down to the surface of the ground 46, but I have shown an embodiment where the foam is terminated at a line 47, painted on the sheet 37 at a height of three feet to simulate a tennis net. Balls that strike the limp sheeting below three feet will not rebound.

Practice with my original apparatus has been described in patent No. 4592547, and this practice can be followed with the present improved apparatus, but the incorporation of a ball-throwing machine that will throw balls through the wall 18 allows for much more stroke practice within a given time period. During practice with the machine 27 balls will be directed at the target hole 43 and score is kept of the number of balls that enter the hole as well as those that clear the stripe on the sheet 12 corresponding to the stripe 50. With the rebound board 33 in place a player can play with a single ball until he fails to strike the board, or two players can bounce th ball to each other, all within a limited space because the rebound is damped.

The foregoing description has been exemplary rather than definitive of my invention for which I desire an award of Letters Patent as defined in the appended claims.

I claim:

1. An apparatus for practicing tennis whereby balls are hit by a player over a simulated net comprising:

(A) a bin for collecting spent tennis balls, (B) a plurality of flexible sheets and a frame for supporting said sheets whereby said sheets deflect said spent balls into said bin, said sheet comprising:

(1) a central back sheet, (2) left and right wing sheets extending therefrom and (3) triangular sheet members connecting said bin to said wing sheets whereby balls striking said wing sheets will enter said bin, (C) a substantially vertical surface of said simulated net defining a narrow opening, (D) a ball-throwing machine, said machine being positioned to throw said spent balls through said opening toward said player, and (E) funnel means for paying said spent balls from said sheets into said said ball-throwing machine.

2. The apparatus of claim 1 wherein said back sheet defines a target hole for said balls.

* * * * *